US011117385B2

(12) United States Patent
Sugiura et al.

(10) Patent No.: US 11,117,385 B2
(45) Date of Patent: Sep. 14, 2021

(54) LIQUID DISCHARGE HEAD

(71) Applicant: Brother Kogyo Kabushiki Kaisha, Nagoya (JP)

(72) Inventors: Keita Sugiura, Toyokawa (JP); Shohei Koide, Nagoya (JP); Keita Hirai, Nagoya (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/824,925

(22) Filed: Mar. 20, 2020

(65) Prior Publication Data

US 2020/0324553 A1 Oct. 15, 2020

(30) Foreign Application Priority Data

Apr. 10, 2019 (JP) ..... JP2019-074731

(51) Int. Cl.

| | |
|---|---|
| ***B41J 2/175*** | (2006.01) |
| ***B41J 2/19*** | (2006.01) |
| ***B41J 2/14*** | (2006.01) |

(52) U.S. Cl.

CPC ..... *B41J 2/17563* (2013.01); *B41J 2/19* (2013.01); *B41J 2002/14403* (2013.01); *B41J 2002/14419* (2013.01); *B41J 2202/12* (2013.01)

(58) Field of Classification Search

CPC ..... B41J 2/19; B41J 2/17563; B41J 2202/12; B41J 2002/14419; B41J 2002/14403; B41J 2/14201; B41J 2/14274; B41J 2/18

See application file for complete search history.

(56) References Cited

U.S. PATENT DOCUMENTS 10,160,226 B2 * 12/2018 Kohda ..... B41J 2/17509

FOREIGN PATENT DOCUMENTS

JP 2017-144660 A 8/2017

* cited by examiner

*Primary Examiner* — Geoffrey S Mruk

(74) *Attorney, Agent, or Firm* — Banner & Witcoff, Ltd.

(57) ABSTRACT

A liquid discharge head includes: a channel member having a nozzle surface and a back surface disposed separately from the nozzle surface, the channel member formed having nozzles arranged in the nozzle surface, individual channels connected to the nozzles, first and second common channels connected to the individual channels, a first opening that is opened in the back surface and communicates with an end of the first common channel, and a second opening that is opened in the back surface and communicates with an end of the second common channel, and a filter member disposed on the back surface and having a filter that covers the first opening. The second opening is not covered with the filter, and an area of the first opening is larger than an area of the second opening.

12 Claims, 12 Drawing Sheets

LIQUID DISCHARGE HEAD

CROSS REFERENCE TO RELATED APPLICATION

The present application claims priority from Japanese Patent Application No. 2019-074731 filed on Apr. 10, 2019, the disclosure of which is incorporated herein by reference in its entirety.

BACKGROUND OF THE INVENTION

Field of the Invention

The present disclosure relates to a liquid discharge head configured to discharge a liquid from nozzles.

Description of the Related Art

As a liquid discharge head that discharges a liquid, there is known a circulation-type head that circulates a liquid in individual liquid chambers. One of advantages of circulating the liquid in the vicinity of the nozzles in the liquid discharge head is exemplified by the discharge of air bubbles entering from the nozzles. There is known a technology in which a means for fining air bubbles is provided in a liquid channel communicating with each nozzle (Japanese Patent Application Laid-open No. 2017-144660). This means inhibits the liquid channel from being clogged with large air bubbles, thus fascinating the discharge of air bubbles.

In order to inhibit foreign matter from entering the circulation-type head, filters may be provided in a supply opening through which the liquid is supplied to the circulation-type head and a discharge opening through which the liquid is discharged from circulation-type head. However, in the circulation-type head provided with the filters, air bubbles entering from the nozzle may be trapped by the filter(s) and the filter(s) may be clogged with the air bubbles. The clogging of the filter(s) deteriorates liquid circulation, thus making the discharge of air bubbles difficult. Further, the clogging of the filter(s) increases the pressure fluctuation and/or flow rate fluctuation in the liquid channel, and thus the discharge of liquid becomes unstable. For example, the meniscus of the liquid in the nozzle is/are broken and the liquid spills out of the nozzle.

An object of the present disclosure is to provide a liquid discharge head that is capable of facilitating the discharge of air bubbles and discharging a liquid stably.

SUMMARY

According to an aspect of the present disclosure, there is provided a liquid discharge head, including:

a channel member having a nozzle surface parallel to a first direction and a second direction perpendicular to the first direction, and a back surface disposed separately from the nozzle surface in a third direction perpendicular to the first direction and the second direction, the channel member formed having a plurality of nozzles arranged in the nozzle surface, a plurality of individual channels connected to the plurality of nozzles, first and second common channels connected to the plurality of individual channels and extending in the first direction, a first opening that is opened in the back surface and communicates with an end at a first side in the first direction of the first common channel, and a second opening that is opened in the back surface and communicates with an end at the first side in the first direction of the second common channel, and a filter member disposed on the back surface and having a filter that covers the first opening, wherein the second opening is not covered with the filter, and an area of the first opening is larger than an area of the second opening.

DESCRIPTION OF THE EMBODIMENTS

First Embodiment

The first embodiment is explained below.

<Schematic Configuration of Printer 1>

Figure 1:
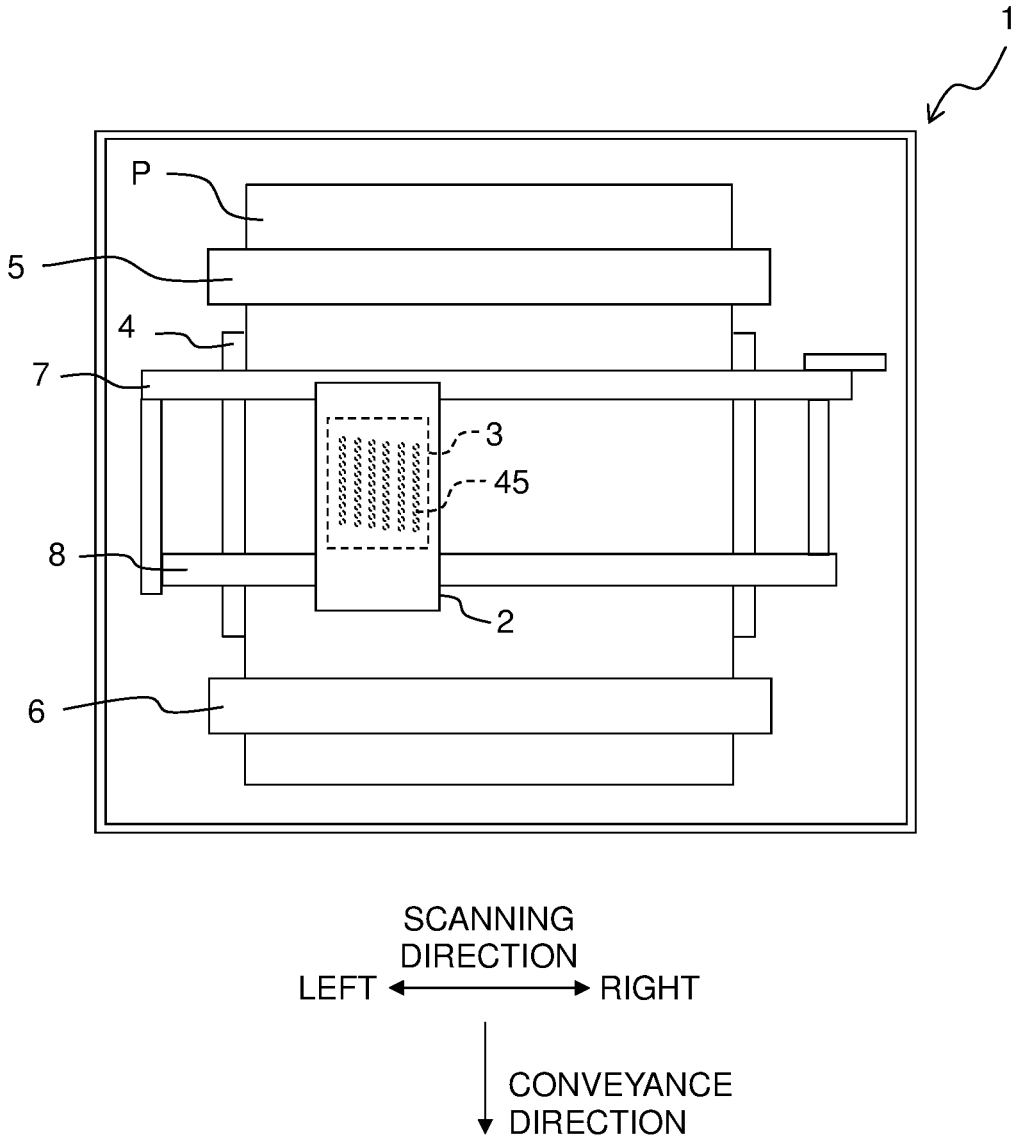
FIG. 1 schematically depicts a configuration of a printer according to the first embodiment.

As depicted in FIG. 1, a printer 1 according to the first embodiment includes a carriage 2, an ink-jet head 3 ("liquid discharge head" of the present disclosure), a platen 4, and conveyance rollers 5 and 6.

The carriage 2 is supported by two guide rails 7 and 8 extending in a scanning direction. The carriage 2 moves in the scanning direction along the guide rails 7 and 8. In the following, a right side and a left side in the scanning direction are defined as indicated in FIG. 1.

The ink-jet head 3 is carried on the carriage 2. The ink-jet head 3 moves in the scanning direction together with the carriage 2. Ink is discharged from nozzles 45 formed in a lower surface ("nozzle surface" of the present disclosure) of the ink-jet head 3. Details of the ink-jet head 3 are explained below.

The platen 4 is disposed to face the lower surface of the ink-jet head 3. The platen 4 extends over an entire length of a recording sheet P in the scanning direction. The platen 4 supports the recording sheet P from below. The conveyance roller 5 is disposed upstream of the carriage 2 in a conveyance direction orthogonal to the scanning direction. The conveyance roller 6 is disposed downstream of the carriage 2 in the conveyance direction. The recording sheet P is conveyed in the conveyance direction by use of the conveyance rollers 5 and 6.

The printer 1 performs printing on the recording sheet P by conveying the recording sheet P in the conveyance direction by a predefined distance by use of the conveyance rollers 5 and 6 and discharging ink from the nozzles 45 of the ink-jet head 3 during the movement of the carriage 2 in the scanning direction every time the recording sheet P is conveyed.

The scanning direction corresponds to a "second direction" of the present disclosure. The conveyance direction corresponds to a "first direction" of the present disclosure. The upstream side and downstream side in the conveyance direction respectively correspond to a "first side in the first direction" and a "second side in the first direction" of the present disclosure. An up-down direction perpendicular to the conveyance direction (first direction) and the scanning direction (second direction) corresponds to a "third direction" of the present disclosure.

<Ink-Jet Head>

Subsequently, details of the ink-jet head 3 are explained below. As depicted in FIGS. 2 to 5, the ink-jet head 3 includes a channel unit 21 ("channel member" of the present disclosure) formed having ink channels such as the nozzles 45 and pressure chambers 40 described below, and a piezoelectric actuator 22 that applies pressure to ink in the pressure chambers 40.

<Channel Unit>

The channel unit 21 is formed by eight plate 31 to 38 stacked on top of each other in that order from the top. The channel unit 21 includes the pressure chambers 40, throttle channels 41, descender channels 42 ("connection channel" of the present disclosure), coupling channels 43 ("circulation channel" of the present disclosure), the nozzles 45, four supply manifolds 46 ("first common channel" and "supply common channel" of the present disclosure), and three return manifolds 47 ("second common channel" and "return common channel" of the present disclosure).

The pressure chambers 40 are formed in the plate 31. Each pressure chamber 40 has a substantially rectangular planar shape that is long in the scanning direction. The pressure chambers 40 are arranged separately from the lower surface ("nozzle surface" of the present disclosure) of the ink-jet head 3 in the up-down direction. The pressure chambers 40 communicate with the supply manifold 46 or the return manifold 47. The pressure chambers 40 are arranged in the conveyance direction to form a pressure chamber row 29. The plate 31 includes 12 pressure chambers rows 29 that are arranged in the scanning direction. The positions in the conveyance direction of the pressure chambers 40 belonging to different pressure chamber rows 29 are different from each other.

The throttle channels 41 extend over the plates 32 and 33. Each of the throttle channels 41 is provided for the corresponding one of the pressure chambers 40. The throttle channels 41 provided for the pressure chambers 40 belonging to odd-numbered pressure chamber rows 29 from the left are connected to left ends of the pressure chambers 40 and extend leftward from connection portions with the pressure chambers 40. The throttle channels 41 provided for the pressure chambers 40 belonging to even-numbered pressure chamber rows 29 from the left are connected to right ends of the pressure chambers 40 and extend rightward from connection portions with the pressure chambers 40.

The descender channels 42 are formed by through holes that are formed in the plates 32 to 37 to overlap with each other in the up-down direction. Each of the descender channels 42 is provided for the corresponding one of the pressure chambers 40. The descender channels 42 provided for the pressure chambers 40 belonging to odd-numbered pressure chamber rows 29 from the left are connected to the right ends of the pressure chambers 40 and extend downward from connection portions with the pressure chambers 40. The descender channels 42 provided for the pressure chambers 40 belonging to even-numbered pressure chamber rows 29 from the left are connected to left ends of the pressure chambers 40 and extend downward from connection portions with the pressure chambers 40.

The coupling channels 43 are formed in the plate 37. Each of the coupling channels 43 is connected to the corresponding one of the descender channels 42. Each coupling channel 43 extends along a plane parallel to the lower surface ("nozzle surface" of the present disclosure) of the ink-jet head 3 to allow the descender channel 42 to communicate with the nozzle 45. The coupling channel 43 extends horizontally while being inclined to the scanning direction and the conveyance direction. The coupling channel 43 connects a lower end of the descender channel 42 connected to the pressure chamber 40 belonging to one of the two adjacent pressure chamber rows 29 and a lower end of the descender channel 42 connected to the pressure chamber 40 belonging to the other pressure chamber row 29. More specifically, the plate 37 has through holes each formed by portions corresponding to the two descender channels 42 and a portion corresponding to the coupling channel 43.

The channel unit 21 includes the individual channels 28 each formed by one coupling channel 43 connected to one nozzle 45, two descender channels 42 connected to the coupling channel 43, two pressure chambers 40 connected to the two descender channels 42, and two throttle channels 41 connected to the two pressure chambers 40. The individual channels 28 are arranged in the conveyance direction to form an individual channel row 27. The channel unit 21 includes 6 individual channel rows 27 arranged in the scanning direction.

The nozzles 45 are formed in the plate 38. Each of the nozzles 45 is provided for the corresponding one of the coupling channels 43. The nozzle 45 is connected to a center portion of the coupling channel 43.

The four supply manifolds 46 are formed by overlapping the through holes formed in the plates 34 and 35 with a concave portion formed in an upper portion of the plate 36 in the up-down direction. The four supply manifolds 46 extend in the conveyance direction. The four supply manifolds 46 are arranged in the scanning direction at intervals. Each of the four supply manifolds 46 is connected to ends at the opposite side of the pressure chambers 40 of the throttle channels 41, which are connected to the pressure chambers 40 belonging to 1, 4, 5, 8, 9, and $12^{th}$ pressure chamber rows 29 from the left.

Each supply manifold 46 extends over the plates 32 to 36 in the up-down direction at its upstream end in the conveyance direction. The upstream end is formed having an inflow opening 48 ("first opening" of the present disclosure). Namely, the inflow opening 48 is opened in an upper surface ("back surface" of the present disclosure) of the channel unit 21 to communicate with the upstream end in the conveyance direction of the supply manifold 46. Although the shape of the inflow opening 48 is not particularly limited, the shape of the inflow opening 48 is, for example, a substantially square. The inflow opening 48 is connected to an ink tank (not depicted) via a filter 51 of a filter member 50. The ink in the ink tank is supplied from the inflow opening 48 to the supply manifold 46. Ink flows through the supply manifold 46 from the upstream side to the downstream side in the conveyance direction and is supplied to the individual channels 28 (throttle channels 41).

The three return manifolds 47 are formed by overlapping the through holes formed in the plates 34 and 35 with the concave portion formed in the upper portion of the plate 36 in the up-down direction. The three return manifolds 47 extend in the conveyance direction. Each return manifold 47 is disposed between the supply manifolds 46 arranged in the scanning direction. Each of the three return manifolds 47 is connected to ends at the opposite side of the pressure chambers 40 of the throttle channels 41, which are connected to the pressure chambers 40 belonging to 2, 3, 6, 7, 10, and $11^{th}$ pressure chamber rows 29 from the left.

Each return manifold 47 extends over the plates 32 to 35 in the up-down direction at its upstream end in the conveyance direction. The upstream end is formed having an outflow opening 49 ("second opening" of the present disclosure). Namely, the outflow opening 49 is opened in the upper surface ("back surface" of the present disclosure) of the channel unit 21 to communicate with the upstream end in the conveyance direction of the return manifold 47. Although the shape of the outflow opening 49 is not particularly limited, the shape of the outflow opening 49 is, for example, a substantially square. The outflow opening 49 is connected to the ink tank (not depicted). Ink flows into each return manifold 47 from the individual channels 28 (throttle channels 41), flows through the return manifold 47 from the downstream side toward the upstream side in the conveyance direction, and flows out of the outflow opening 49 via a through hole 52 of the filter member 50. Ink flowing out of the outflow opening 49 returns to the ink tank (not depicted). Namely, in the first embodiment, ink circulates between the ink-jet head 3 and the ink tank (not depicted).

A pump (not depicted) is provided in a channel connecting inflow openings 48 and the ink tank or in a channel connecting outflow openings 49 and the ink tank. The ink flow caused by driving the pump circulates ink as described above.

An area S1 of the inflow opening 48 is larger than an area S2 of the outflow opening 49. The supply manifolds 46 extend toward the upstream side in the conveyance direction beyond the return manifolds 47. In that configuration, the inflow openings 48 are positioned at the upstream side in the conveyance direction from the outflow openings 49. In other words, the outflow openings 49 are disposed between the piezoelectric actuator 22 and the inflow openings 48 in the conveyance direction. Namely, the position in the conveyance direction of the inflow openings 48 is different from the position in the conveyance direction of the outflow openings 49.

The supply manifolds 46 and the return manifolds 47 are arranged alternating in the scanning direction by arranging the four supply manifolds 46 and the three return manifolds 47 as described above. From among the supply manifolds 46 and the return manifolds 47 arranged alternating in the scanning direction, two manifolds positioned at both ends in the scanning direction are the supply manifolds 46.

The plate 37 is formed having damper chambers 59, which overlap in the up-down direction with the supply manifolds 46 while separating therefrom. The pressure fluctuation of the ink in each supply manifold 46 is inhibited by deforming a partition wall, which is formed by a lower end of the plate 36 to separate the supply manifold 46 from the dumper chamber 59. The plate 37 is formed having damper chambers 58, which overlap in the up-down direction with the return manifolds 47 while separating therefrom. The pressure fluctuation of the ink in each return manifold 47 is inhibited by deforming a partition wall, which is formed by the lower end of the plate 36 to separate the return manifold 47 from the dumper chamber 58.

<Filter Member>

The filter member 50 having the filters 51 that cover the respective inflow openings 48 is disposed on the upper surface ("back surface" of the present disclosure) of the channel unit 21. The filter member 50 is, for example, a plate-like body made from metal, such as nickel or stainless steel (SUS). The filter member 50 is formed having the filters 51 in which pores 53 are formed. Each filter 51 is, for example, an electroforming filter. The inflow openings 48 and outflow openings 49 are arranged in an area surrounded by an outer circumference of the filter member 50 when seen from the up-down direction. The filter member 50 is disposed to overlap in the up-down direction with the inflow openings 48 and the outflow openings 49. The filter member 50 is formed having through holes 52 that communicate with the outflow openings 49. Namely, the inflow openings 48 are covered with the filters 51 of the filter member 50, and the outflow openings 49 are covered with no filters. The size of the filter 51 may be the same as or larger than that of the inflow opening 48. The size of the through hole 52 may be the same as or larger than that of the outflow opening 49.

The dimension (area) of the filter 51 is larger than that of the through hole 52. Further, the filters 51 are positioned upstream of the through holes 52 in the conveyance direction. In other words, the through holes 52 are disposed between the piezoelectric actuator 22 and the filters 51 in the conveyance direction.

Ink circulating between the ink-jet head 3 and the ink tank (not depict) is supplied from the inflow opening 48 to the supply manifold 46 through the filter 51 of the filter member 50. After passing through the individual channels 28, ink returns to the return manifold 47 and flows out of the outflow opening 49 through the through hole 52 of the filter member 50. Then, ink returns to the ink tank (not depicted).

<Piezoelectric Actuator>

The piezoelectric actuator 22 includes two piezoelectric layers 61 and 62, a common electrode 63, and individual electrodes 64. The piezoelectric layers 61 and 62 are made using a piezoelectric material composed primarily of lead zirconate titanate (PZT), which is a mixed crystal of lead titanate and lead zirconate. The piezoelectric layer 61 is disposed on the upper surface of the channel unit 21. The piezoelectric layer 62 is disposed on an upper surface of the piezoelectric layer 61. The material used for the piezoelectric layer 61 may be different from that used for the piezoelectric layer 62. The piezoelectric layer 61 may be made using any other insulating material than the piezoelectric material, such as a synthetic resin material.

The common electrode 63 is disposed between the piezoelectric layer 61 and the piezoelectric layer 62. The common electrode 63 continuously extends over a substantially entire area of the piezoelectric layers 61 and 62. The common electrode 63 is kept at a ground potential. Each of the individual electrodes 64 is provided for the corresponding one of the pressure chambers 40. Each individual electrode 64 has a substantially rectangular planar shape that is long in the scanning direction. Each individual electrode 64 is disposed to overlap in the up-down direction with a center portion of the corresponding pressure chamber 40. An end at an opposite side of the descender channel 42 in the scanning direction of each individual electrode 64 extends to a position that does not overlap in the up-down direction with the pressure chamber 40, and the tip thereof functions as a connection terminal 64*a*. A trace member (not depicted) is connected to each connection terminal 64*a*. The connection terminals 64*a* of the individual electrodes 64 are connected to a driver IC (not depicted) via the trace members (not depicted). The driver IC selectively applies any of the ground potential and a predefined driving potential (e.g., about 20V) to the respective individual electrodes 64. Corresponding to the arrangement of the common electrode 63 and the individual electrodes 64 as described above, a portion of the piezoelectric layer 62 interposed between the common electrode 63 and each individual electrode 64 is an active portion polarized in a thickness direction.

A method for discharging ink from a certain nozzle 45 included in the nozzles 45 by driving the piezoelectric actuator 22 is explained. In the piezoelectric actuator 22, all the individual electrodes 64 are kept at the ground potential that is the same as the common electrode 63 in a standby state in which no ink is discharged from the nozzle 45. When ink is discharged from the certain nozzle 45, the electrical potential of two individual electrodes 64 corresponding to two pressure chambers 40 connected to the certain nozzle 45 is switched from the ground potential to the driving potential.

This generates an electric field parallel to a polarization direction in two active portions corresponding to the two individual electrodes 64, which contracts the two active portions in a horizontal direction orthogonal to the polarization direction. Thus, portions of the piezoelectric layers 61 and 62 overlapping in the up-down direction with the two pressure chambers 40 are deformed to convex toward the pressure chambers 40 as a whole. This reduces the volume of the pressure chambers 40 to increase the pressure of ink in the pressure chambers 40, thus discharging ink from the nozzle 45 communicating with the pressure chambers 40. After ink is discharged from the nozzle 45, the electric potential of the two individual electrodes 64 is returned to the ground potential. The piezoelectric layers 61 and 62 thus return to the state before deformation.

The ink-jet head 3 of this embodiment described above has, for example, the following function and effect. In the ink-jet head 3, the inflow openings 48 are covered with the filters 51 of the filter member 50, and the outflow openings 49 are covered with no filters. Covering the inflow openings 48 with the filters 51 allows the filters 51 to catch foreign matter and the like in the ink, thus inhibiting the foreign matter from entering the channel unit 21. The outflow openings 49 are not covered with the filters 51, and thus air bubbles from the nozzles 45 are discharged from the channel unit 21 without being trapped by the filters 51 (without causing clogging of the filters). Since no filters are clogged with air bubbles, ink can be discharged from the nozzles 45 stably.

In the ink-jet head 3 of this embodiment, the area S1 of the inflow opening 48 is larger than the area S2 of the outflow opening 49. When the area S1 of the inflow opening 48 is the same as or smaller than the area S2 of the outflow opening 49, a flow resistance of the ink passing through the filter 51 and the inflow opening 48 and then flowing toward the nozzle 45 (hereinafter referred to as a "flow resistance of inflow ink" as appropriate) is larger than a flow resistance of the ink flowing from the nozzle 45 toward the outflow opening 49 (hereinafter referred to as a "flow resistance of outflow ink" as appropriate). This is because the filters 51 having a large flow resistance are provided only for the inflow openings 48. A large difference between the flow resistance of the inflow ink and the flow resistance of the outflow ink increases the pressure fluctuation and the flow rate fluctuation in the liquid channel, making ink discharge unstable. In this embodiment, the area S1 of the inflow opening 48 is larger than the area S2 of the outflow opening 49, reducing the difference between the flow resistance of the inflow ink and the flow resistance of the outflow ink. It is thus possible to inhibit the pressure fluctuation and the flow rate fluctuation in the liquid channel, and to discharge ink from the nozzle 45 stably.

For example, the flow resistance of the inflow ink is defined as a flow resistance (first flow resistance $R_{in}$) of ink that passes through the filter 51 of the filter member 50 having a thickness t, flows into the supply manifold 46 through the inflow opening 48, and flows through the supply manifold 46 by a predefined length L. For example, the flow resistance of the outflow ink is defined as a flow resistance (second flow resistance $R_{out}$) of ink that flows through the return manifold 47 by the predefined length L to reach the outflow opening 49 and passes through the through hole 52 of the filter member 50. The flow resistance ($R_{in}$) of the inflow ink and the flow resistance ($R_{out}$) of the outflow ink are represented by the following equations (1) and (2).

$$R_{in} = \frac{8\mu L}{\pi r_{in}^4} + \frac{8\mu t}{\pi d^4} \times \frac{1}{n} \tag{1}$$

$$R_{out} = \frac{8\mu(L+t)}{\pi r_{out}^4} \tag{2}$$

In the equations (1) and (2), meanings of the symbols are as follows:

μ: ink viscosity

L: a predefined length through which ink flows

T: a thickness of the filter member $r_{in}$: a radius of a circle provided that the inflow opening 48 is a circle having the area S1 (hereinafter referred to as an "equivalent radius of the inflow opening 48")

$r_{out}$: a radius of a circle provided that the outflow opening 49 is a circle having the area S2 (hereinafter referred to as an "equivalent radius of the outflow opening 49")

d: a radius of a circle provided that each pore 53 of the filter 51 is a circle having the same area as the pore 53 n: the number of the pores 53 of the filter 51

In the equation (1), it is assumed that ink flows through part of the supply manifold 46 having the same cross-sectional area (area S1) as the inflow opening 48 by the predefined length L. In the equation (2), it is assumed that ink flows through part of the return manifold 47 having the same cross-sectional area (area S2) as the outflow opening 49 by the predefined length L (see FIG. 5). The flow resistance ($R_{in}$) of the inflow ink represented by the equation (1) is a flow resistance of ink that flows through the vicinity of the filter 51 and the inflow opening 48 by a relatively short distance (L). The flow resistance ($R_{out}$) of the outflow ink represented by the equation (2) is a flow resistance of ink that flows through the vicinity of the outflow opening 49 by a relatively short distance (L). The predefined length L is, for example, a portion of the supply manifold 46 passing through the plates 31 and 32 in the up-down direction. The predefined length L is, for example, a portion of the return manifold 47 passing through the plates 31 and 32 in the up-down direction.

The difference between the flow resistance of the inflow ink that flows from the inflow opening 48 to the nozzle 45 and the flow resistance of the outflow ink that flows from the nozzle 45 to the outflow opening 49 can be reduced by reducing the difference between the flow resistance (i.e., the flow resistance ($R_{in}$) represented by the equation (1)) of the inflow ink that flows through the vicinity of the filter 51 and the inflow opening 48, and the flow resistance (i.e., the flow resistance ($R_{out}$) represented by the equation (2)) of the outflow ink that flows through the vicinity of the outflow opening 49. This inhibits the pressure fluctuation and the flow rate fluctuation in the liquid channel, thus discharging ink from the nozzle 45 stably. An absolute value of the difference between the flow resistance ($R_{in}$) of the inflow ink represented by the equation (1) and the flow resistance ($R_{out}$) of the outflow ink represented by the equation (2) is preferably small. The absolute value is for example, not more than 1 kPa per an ink viscosity of 1 mPa·s.

There is considered an ideal case where the flow resistance ($R_{in}$) is equal to the flow resistance ($R_{out}$), like the following equation (3). In this case, an equivalent radius $r_{in}$ of the inflow opening 48 and an equivalent radius $r_{out}$ of the outflow opening 49 indicate a relationship represented by the following equation (4).

$$R_{in} = R_{out} \tag{3}$$

$$r_{out}^4 = \frac{nd^4 r_{in}^4}{nd^4 L + r_{in}^4 t}(L + t) \tag{4}$$

As understood from the equation (4), the equivalent radius $r_{in}$ of the inflow opening 48 and the equivalent radius $r_{out}$ of the outflow opening 49 (i.e., the area S1 of the inflow opening 48 and the area S2 of the outflow opening 49) can be designed to follow the configuration of the ink-jet head 3 so that the flow resistance ($R_{in}$) of the inflow ink is equal to the flow resistance ($R_{out}$) of the outflow ink or so that the absolute value of the difference between the flow resistance ($R_{in}$) of the inflow ink and the flow resistance ($R_{out}$) of the outflow ink is within a predefined range.

In the ink-jet head 3, the outflow openings 49 are arranged between the piezoelectric actuator 22 and the inflow openings 48 in the conveyance direction. Namely, the inflow openings 48 are arranged upstream of the outflow openings 49 in the conveyance direction. The outflow openings 49 are arranged between the piezoelectric actuator 22 and the filters 51 of the filter member 50 in the conveyance direction. Thus, the filters 51 of the filter member 50 can be arranged further separately from the piezoelectric actuator 22 that is a heat generation source. This inhibits the thermal deformation of the pores 53 of the filters 51.

<First to Fourth Modified Examples>

In ink-jet heads 81 to 84 according to the first to fourth modified examples, the shapes, arrangement, and the like of the inflow openings 48 and the outflow openings 49 are changed from those of the ink-jet head 3 according to the first embodiment, as depicted in FIGS. 6 to 9. Any other configurations than the above are similar to those of the ink-jet head 3 according to the first embodiment. In FIGS. 6 to 9, the constitutive parts or components, which are the same as or equivalent to those of the first embodiment, are designated by the same reference numerals. Similar to the first embodiment, in the ink-jet heads 81 to 84 according to the first to fourth modified examples, the inflow openings 48 are covered with the filters 51 of the filter member 50 and the outflow openings 49 are covered with no filters. The area S1 of the inflow opening 48 is larger than the area S2 of the outflow opening 49. Accordingly, in the ink-jet heads according to the first to fourth modified examples, it is possible to inhibit foreign matter from entering the channel unit 21, to facilitate the discharge of air bubbles, and to discharge ink stably similar to the first embodiment.

Figure 5:
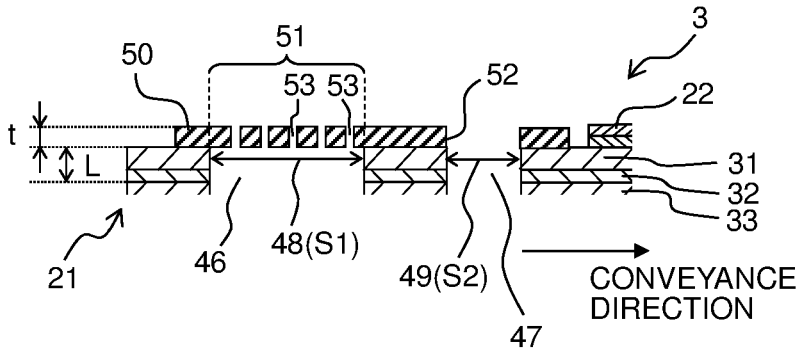
FIG. 5 is a cross-sectional view taken along a line V-V in FIG. 2.
Figure 6:
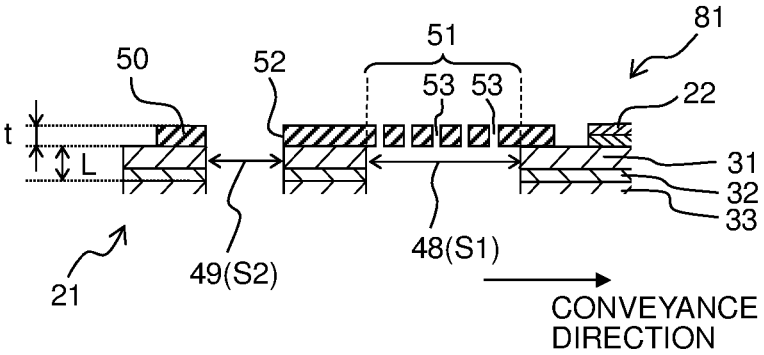
FIG. 6 is a schematic cross-sectional view of the vicinity of an inflow opening and an outflow opening in an ink-jet head according to the first modified example.

In the ink-jet head 3 according to the first embodiment, the outflow openings 49 are arranged between the piezoelectric actuator 22 and the inflow openings 48 in the conveyance direction (see FIG. 5). The present disclosure, however, is not limited thereto. As depicted in FIG. 6, in the ink-jet head 81 according to the first modified example, the inflow openings 48 are arranged between the piezoelectric actuator 22 and the outflow openings 49 in the conveyance direction. Namely, the outflow openings 49 are disposed upstream of the inflow openings 48 in the conveyance direction. The filters 51 of the filter member 50 are disposed downstream of the outflow openings 49 in the conveyance direction. In that configuration, the flow resistance of the inflow ink flowing toward the nozzles 45 (to the nozzle 45) can be decreased by arranging the filters 51 having a high flow resistance in positions closer to the nozzles 45. This makes the difference between the flow resistance of the inflow ink and the flow resistance of the outflow ink small, thus discharging ink from the nozzles 45 stably.

Figure 7:
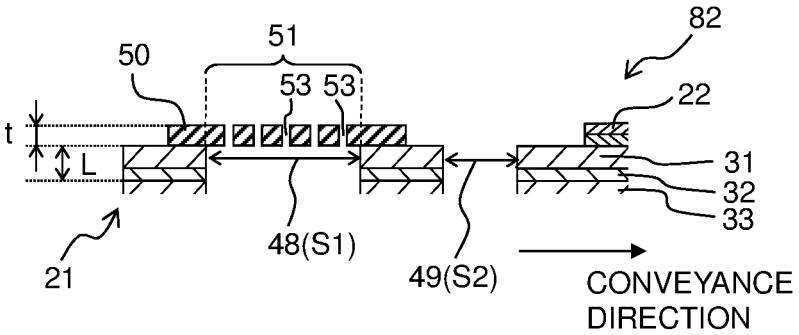
FIG. 7 is a schematic cross-sectional view of the vicinity of an inflow opening and an outflow opening in an ink-jet head according to the second modified example.

In the ink-jet head 3 of the first embodiment, the inflow openings 48 and the outflow openings 49 are arranged in the area surrounded by the outer circumference of the filter member 50 when seen from the up-down direction. The filter member 50 is formed having the through holes 52 that communicate with the outflow openings 49 (see FIG. 5). The present disclosure, however, is not limited thereto. In the ink-jet head 82 of the second modified example, the filter member 50 is disposed not to overlap with the outflow openings 49 in the up-down direction, as depicted in FIG. 7. The through holes 52 communicating with the outflow openings 49 are not formed in the filter member 50, and the filter member 50 only covers the inflow openings 48. In the second modified example, since the filter member 50 is downsized, the costs of the ink-jet head can be reduced. Further, since the position adjustment between the outflow openings 49 and the through holes 52 provided for the filter member 50 is not necessary in this second modified example, the efficiency of the manufacturing steps is improved.

Figure 2:
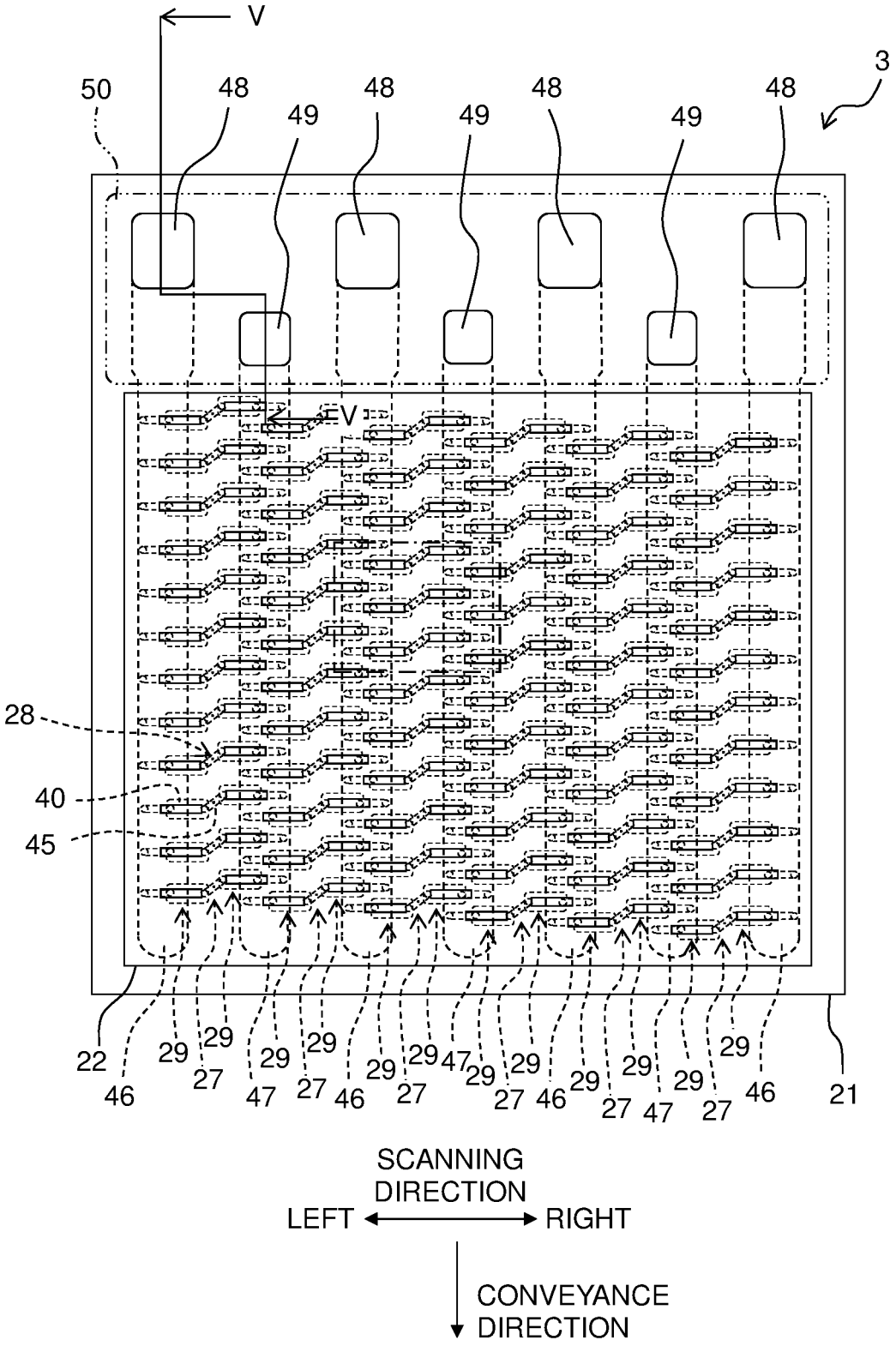
FIG. 2 is a plan view of an ink-jet head in FIG. 1.
Figure 3:
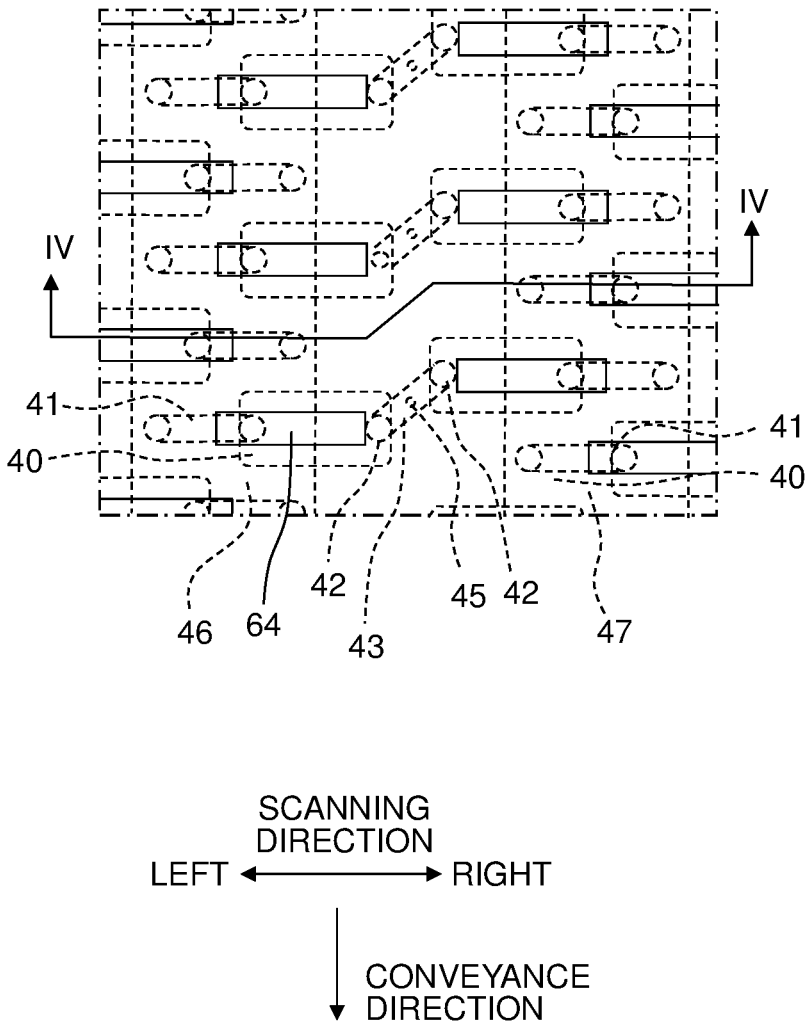
FIG. 3 is an enlarged view of a portion surrounded by a dot-dash chain line in FIG. 2.
Figure 4:
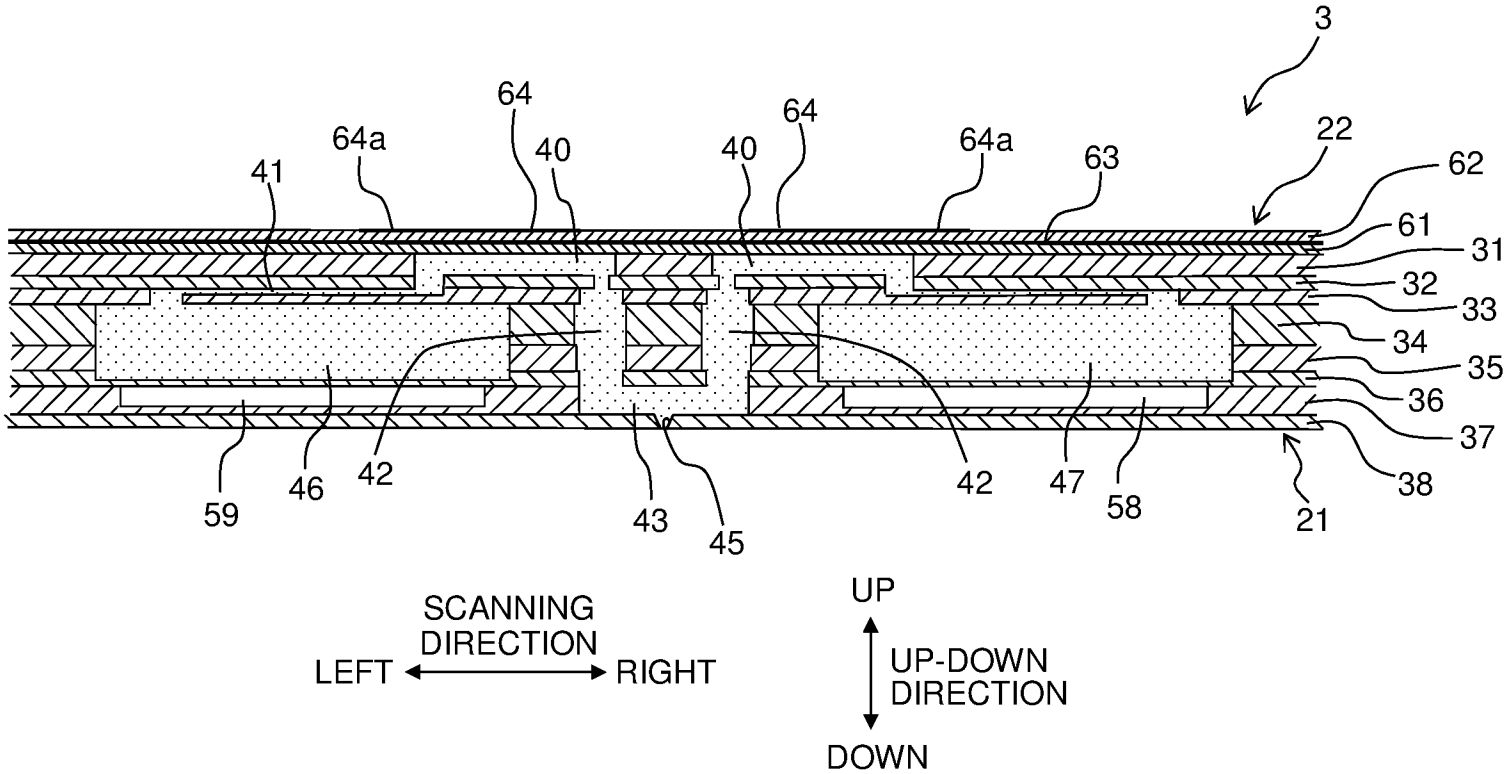
FIG. 4 is a cross-sectional view taken along a line IV-IV in FIG. 3.
Figure 8:
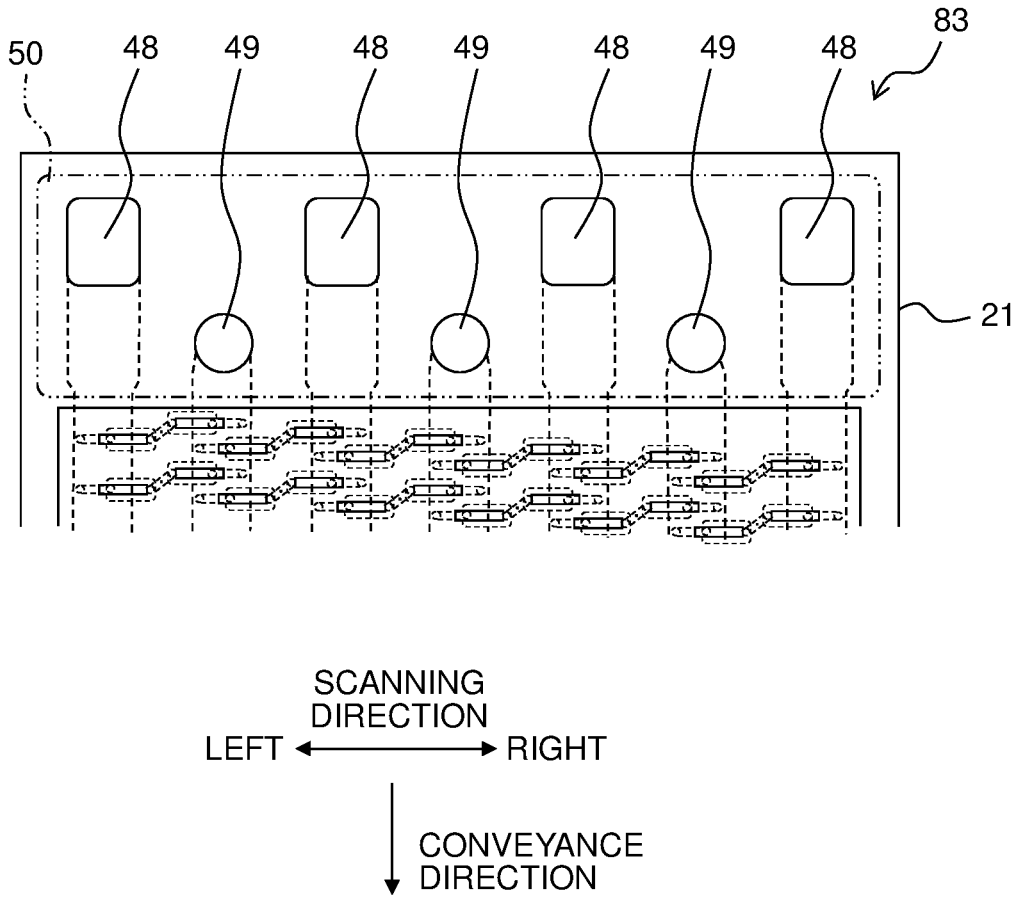
FIG. 8 is a schematic plan view of the vicinity of an inflow opening and an outflow opening in an ink-jet head according to the third modified example.

In the ink-jet head 3 according to the first embodiment, the shape of the outflow openings 49 is a substantially square (see FIG. 2). The present disclosure, however, is not limited thereto. As depicted in FIG. 8, in the ink-jet head 83 of the third modified example, the shape of the outflow openings 49 is circular as depicted in FIG. 8. When the shape of the outflow openings 49 is circular, the discharge of air bubbles from the channel unit 21 can be further facilitated due to the following mechanism. When the air bubbles intruding from the nozzles 45 are sufficiently smaller than the size of the outflow openings 49, the air bubbles are discharged from the channel unit 21 through the outflow openings 49. When air bubbles are larger than or almost the same as the size of the outflow openings 49, the air bubbles may be caught by the outflow openings 49 and may not be discharged from the discharge unit 21. In this case, when the shape of the outflow openings 49 is circular, the outflow openings 49 are completely clogged with spherical air bubbles. Since ink circulates between the ink-jet head 3 and the ink tank (not depicted), a great pressure difference is caused between the upstream side (an inner side of the channel unit 21) and the downstream side (an outer side of the channel unit 21) of the outflow openings 49 when the outflow openings 49 are completely clogged with air bubbles. The pressure difference deforms air bubbles and the deformed air bubbles pass through the outflow openings 49 and discharged outside the channel unit 21.

Figure 9:
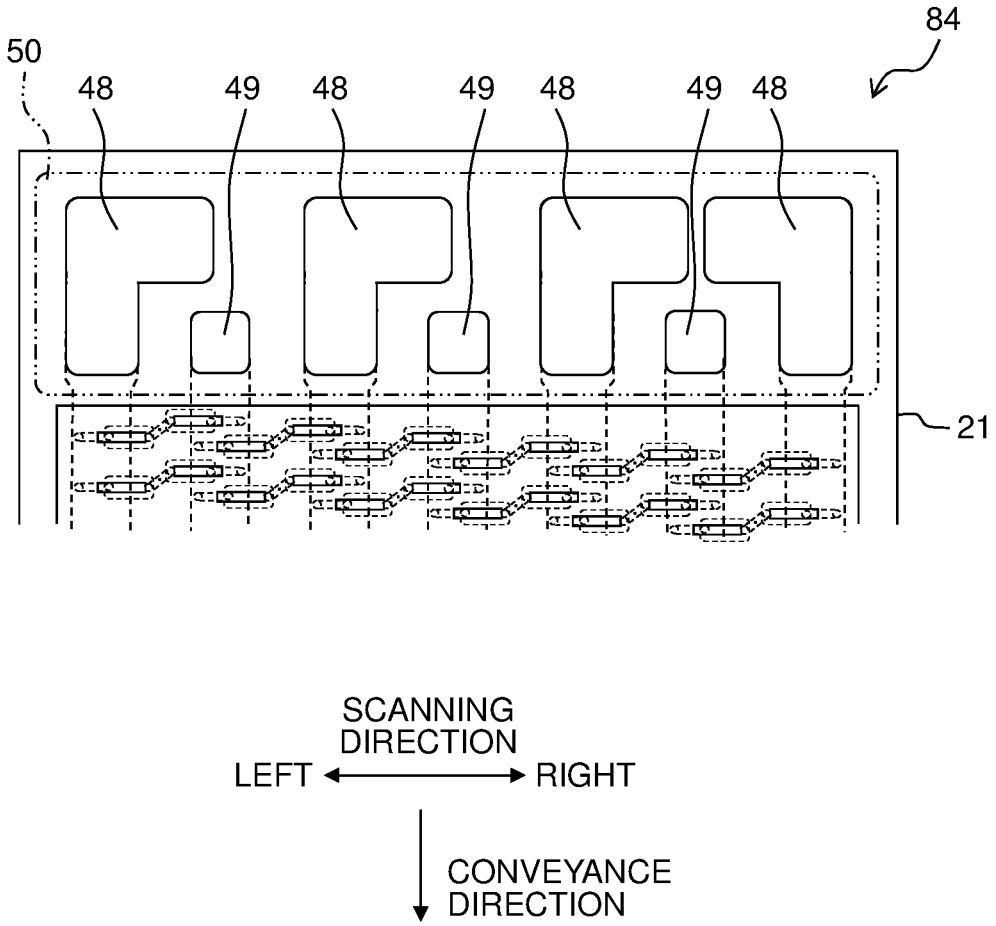
FIG. 9 is a schematic plan view of the vicinity of an inflow opening and an outflow opening in an ink-jet head according to the fourth modified example.

In the ink-jet head 3 of the first embodiment, the inflow openings 48 and the outflow openings 49 are not arranged side by side in the conveyance direction and the scanning direction. The inflow openings 48 and the outflow openings 49 are arranged zigzag (see FIG. 2). The present disclosure, however, is not limited thereto. In the ink-jet head 84 of the fourth modified example, as depicted in FIG. 9, the outflow openings 49 and parts of the inflow openings 48 are arranged side by side in the conveyance direction. The outflow openings 49 and another parts of the inflow openings 48 are arranged side by side in the scanning direction. Each inflow opening 48 extends in the scanning direction so that the part of the inflow opening 48 and outflow opening 49 are arranged side by side in the conveyance direction, and extends in the conveyance direction so that the another part of the inflow opening 48 and the outflow opening 49 are arranged side by side in the scanning direction. Each inflow opening 48 has a substantially L shape. As described above, the difference between the flow resistance of the inflow ink and the flow resistance of the outflow ink can be reduced by making the area of the inflow openings 48 larger than the area of the outflow openings 49. This allows ink to be stably discharged from the nozzles 45.

Second Embodiment

Subsequently, the second embodiment is explained. In the second embodiment, the arrangement and the like of supply manifolds and return manifolds in an ink-jet head are different from those of the first embodiment.

Figure 10:
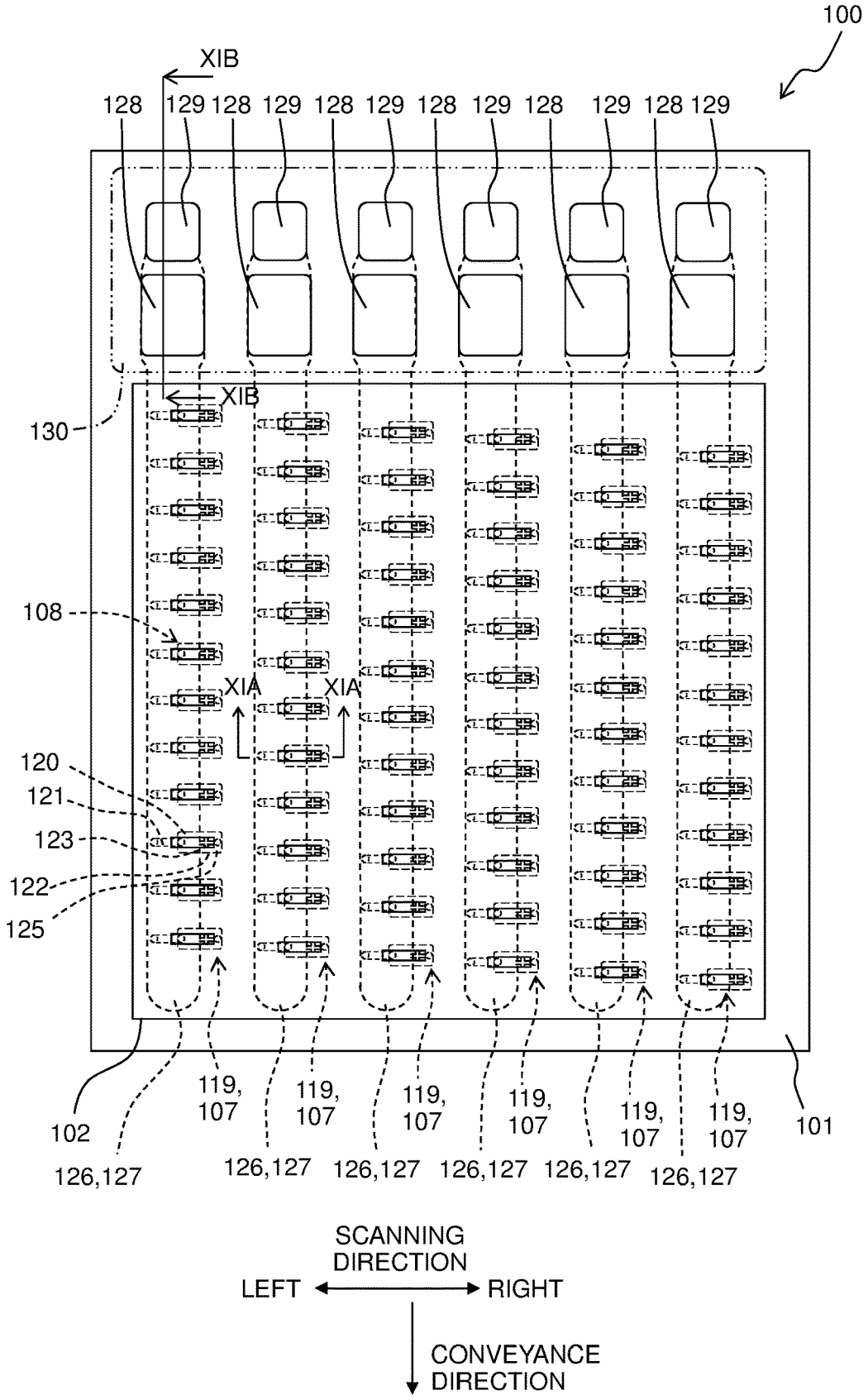
FIG. 10 is a plan view of an ink-jet head according to the second embodiment.
Figure 11A:
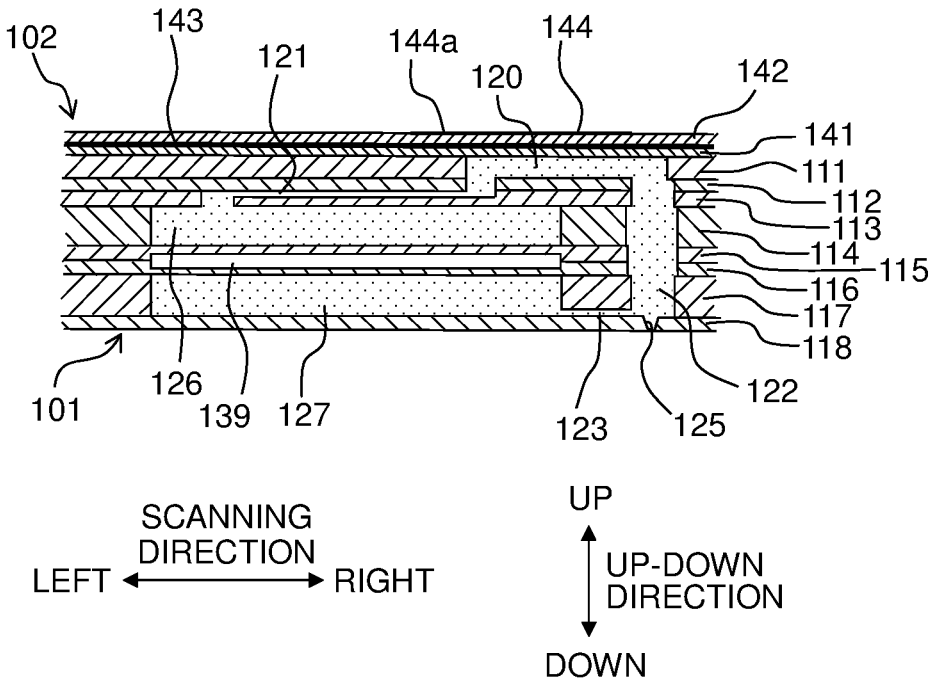
FIG. 11A is a cross-sectional view taken along a line XIA-XIA in FIG. 10.
Figure 11B:
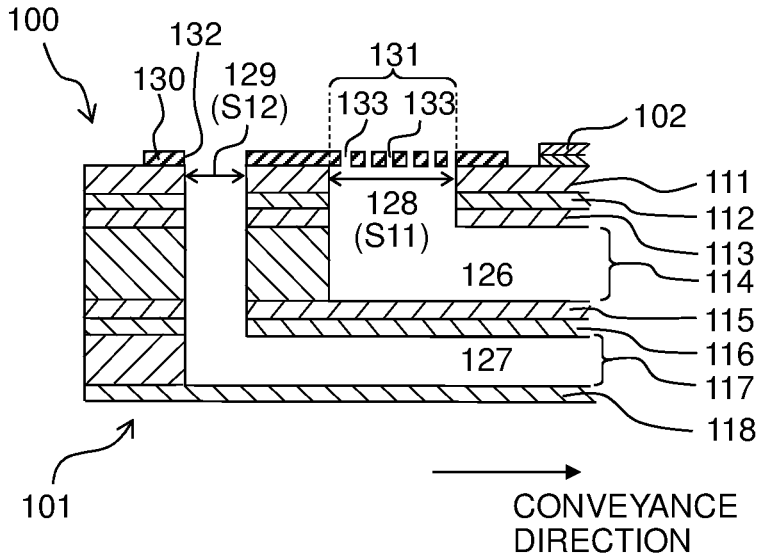
FIG. 11B is a cross-sectional view taken along a line XIB-XIB in FIG. 10.

As depicted in FIGS. 10 and 11, an ink-jet head 100 according to the second embodiment includes a channel unit 101 ("channel member" of the present disclosure) and a piezoelectric actuator 102.

<Channel Unit>

The channel unit 101 is formed by eight plates 111 to 118, which are stacked on top of each other in that order from the top. The channel unit 101 includes pressure chambers 120, throttle channels 121, descender channels 122 ("connection channel" of the present disclosure), circulation channels 123, nozzles 125, six supply manifolds 126 ("first common channel" and "supply common channel" of the present disclosure), and six return manifolds 127 ("second common channel" and "return common channel" of the present disclosure).

The pressure chambers 120 are formed in the plate 111. The pressure chambers 120 have a similar shape as the pressure chambers 40 (see FIG. 2). The pressure chambers 120 are arranged separately from a lower surface ("nozzle surface" of the present disclosure) of the ink-jet head 100 in the up-down direction. The pressure chambers 120 communicate with the supply manifolds 126. The pressure chambers 120 are arranged in the conveyance direction to form pressure chamber rows 119. The plate 111 is formed having six pressure chamber rows 119 arranged in the scanning direction. The pressure chambers 120 belonging to different pressure chamber rows 119 have different positions in the conveyance direction.

The throttle channels 121 extend over the plates 112 and 113. The throttle channels 121 have a similar shape as the throttle channels 41 (see FIG. 2). Each of the throttle channels 121 is provided for the corresponding one of the pressure chambers 120. Each throttle channel 121 is connected to a left end of the corresponding pressure chamber 120 and extends leftward from the connection portion with the corresponding pressure chamber 120.

The descender channels 122 are formed by through holes formed in the plates 112 to 117 that overlap with each other in the up-down direction. Each of the descender channel 122 is provided for the corresponding one of the pressure chambers 120. Each descender channel 122 is connected to a right end of the corresponding pressure chamber 120 and extends downward from the connection portion with the corresponding pressure chamber 120.

The circulation channels 123 are formed in a lower portion of the plate 117. The circulation channels 123 are connected to the descender channels 122 and extend along a plane parallel to the lower surface ("nozzle surface" of the present disclosure) of the ink-jet head 100. Each of the circulation channels 123 is provided for the corresponding one of the descender channels 122. Each circulation channel 123 is connected to a lower left end of a side wall surface of the corresponding descender channel 122 and extends leftward from the connection portion with the corresponding descender channel 122. The nozzles 125 are formed in the plate 118. Each of the nozzles 125 is provided for the corresponding one of the descender channels 122. Each nozzle 125 is connected to a lower end of the descender channel 122.

From among the ink channels as described above, each individual channel 108 is formed by the descender channel 122 connected to the nozzle 125, the circulation channel 123 and the pressure chamber 120 connected to the descender channel 122, and the throttle channel 121 connected to the pressure chamber 120. The individual channels 108 are arranged in the conveyance direction to form an individual channel row 107. The channel unit 101 includes six individual channel rows 107 arranged in the scanning direction.

The six supply manifolds 126 are formed in the plate 114. The six supply manifolds 126 extend in the conveyance direction, and are arranged in the scanning direction at intervals. The six supply manifolds 126 correspond to six individual channel rows 107, respectively. Each of the supply manifolds 126 is connected to the throttle channels 121 of the individual channels 108 belonging to the corresponding one of the individual channel rows 107.

Each supply manifold 126 extends over the plates 112 to 114 in the up-down direction at its upstream end in the conveyance direction. An inflow opening 128 ("first opening" of the present disclosure) is provided at its upstream end. Namely, the inflow openings 128 are opened in an upper surface ("back surface" of the present disclosure) of the channel unit 101. The inflow openings 128 communicate with the upstream ends in the conveyance direction of the supply manifolds 126. The inflow openings 128 are connected to the ink tank (not depicted) via filters 131 of a filter member 130. The ink in the ink tank is supplied from the inflow openings 128 to the supply manifolds 126. Ink flows through each supply manifold 126 from the upstream side toward the downstream side in the conveyance direction, and supplied to the individual channels 108 (throttle channels 121).

The six return manifolds 127 are formed in the plate 117. The six return manifolds 127 extend in the conveyance direction, and are arranged in the scanning direction at intervals. The six return manifolds 127 overlap in the up-down direction with the supply manifolds 126. In that configuration, the supply manifolds 126 are positioned above the return manifolds 127. The return manifolds 127 extend toward the upstream side in the conveyance direction beyond the supply manifolds 126.

Each return manifold 127 extends over the plates 112 to 117 in the up-down direction at its upstream end in the conveyance direction. An outflow opening 129 ("second opening" of the present disclosure) is provided at its upstream end. Namely, the outflow openings 129 are opened in the upper surface ("back surface" of the present disclosure) of the channel unit 101. The outflow openings 129 communicate with the upstream ends in the conveyance direction of the return manifolds 127. The outflow openings 129 are connected to the ink tank (not depicted) via through holes 132 of the filter member 130. Ink comes from the individual channels 108 (throttle channels 121), flows through the return manifold 129 from the downstream side toward the upstream side in the conveyance direction, and flows out of the outflow opening 129. The ink flowing out of the outflow opening 129 returns to the ink tank (not depicted). Namely, in the second embodiment, ink circulates between the ink-jet head 100 and the ink tank (not depicted).

A pump (not depicted) is provided in a channel connecting inflow openings 128 and the ink tank or in a channel connecting outflow openings 129 and the ink tank. The ink flow caused by driving the pump circulates ink as described above.

As described above, the return manifolds 127 extend toward the upstream side in the conveyance direction beyond the supply manifolds 126. In that configuration, the outflow openings 129 are arranged upstream of the inflow openings 128 in the conveyance direction. The inflow openings 128 and the outflow openings 129 are arranged side by side in the conveyance direction. In other words, the inflow openings 128 are arranged between the piezoelectric actuator 102 and the outflow openings 129 in the conveyance direction. Namely, the position in the conveyance direction of the inflow openings 128 is different from the position in the conveyance direction of the outflow openings 129. An area S11 of the inflow opening 128 is larger than an area S12 of the outflow opening 129.

The channel unit 101 includes damper chambers 139, which extend over a lower portion of the plate 115 and an upper portion of the plate 116 to overlap in the up-down direction with the supply manifolds 126 and the return manifolds 127. The pressure fluctuation of ink in the supply manifold 126 is inhibited by deforming a partition wall that is formed by an upper end of the plate 115 to separate the supply manifold 126 from the damper chamber 139. The pressure fluctuation of ink in the return manifold 127 is inhibited by deforming a partition wall that is formed by a lower end of the plate 116 to separate the return manifold 127 from the damper chamber 139.

<Filter Member>

The filter member 130 having the filters 131 that cover the inflow openings 128 is provided on the upper surface ("back surface" of the present disclosure) of the channel unit 101. The filter member 130 is, for example, a plate-like body made from metal, such as nickel or stainless steel (SUS). The filter member 130 is formed having the filters 131 in which pores 133 are formed. The filter 131 is, for example, an electroforming filter. The inflow openings 128 and outflow openings 129 are arranged in an area surrounded by an outer circumference of the filter member 130 when seen from the up-down direction. The filter member 130 is disposed to overlap in the up-down direction with the inflow openings 128 and the outflow openings 129. The filter member 130 is formed having the through holes 132 that communicate with the outflow openings 129. Namely, the inflow openings 128 are covered with the filters 131 of the filter member 130, and the outflow openings 129 are covered with no filters. The size of the filter 131 may be the same as or larger than that of the inflow opening 128. The size of the through hole 132 may be the same as or larger than that of the outflow opening 129.

The dimension (area) of the filter 131 is larger than that of the through hole 132. Further, the filters 131 and the through holes 132 are arranged side by side in the conveyance direction. The through holes 132 are positioned upstream of the filters 131 in the conveyance direction. In other words, the filters 131 are disposed between the piezoelectric actuator 102 and the through holes 132 in the conveyance direction.

Ink circulating between the ink-jet head 100 and the ink tank (not depicted) passes through the filter 131 of the filter member 130 and is supplied to the supply manifold 126 through the outflow opening 128. After passing through the individual channels 108, ink returns to the return manifold 127, flows out of the outflow opening 129 through the through hole 132 of the filter member 130, and then returns to the ink tank (not depicted).

<Piezoelectric Actuator>

The piezoelectric actuator 102 includes two piezoelectric layers 141 and 142, a common electrode 143, and individual electrodes 144. The piezoelectric layers 141 and 142 are made from a piezoelectric material. The piezoelectric layer 141 is disposed on an upper surface of the channel unit 101, and the piezoelectric layer 142 is disposed on an upper surface of the piezoelectric layer 141. Similar to the piezoelectric layer 61 (see FIG. 4), the piezoelectric layer 141 may be made from any other insulating material than the piezoelectric material.

The common electrode 143 is disposed between the piezoelectric layers 141 and 142. The common electrode 143 continuously extends over a substantially entire area of the piezoelectric layers 141 and 142. The common electrode 143 is kept at the ground potential. Each of the individual electrodes 144 is provided for the corresponding one of the pressure chambers 120. Each individual electrode 144 has substantially a similar shape as the individual electrode 64 (see FIG. 2). Each individual electrode 144 is disposed to overlap in the up-down direction with a center portion of the corresponding pressure chamber 120. Connection terminals 144*a* of the individual electrodes 144 are connected to a driver IC (not depicted) via trace members (not depicted). The driver IC selectively applies any of the ground potential and a driving potential to the respective individual electrodes 144. Corresponding to the arrangement of the common electrode 143 and the individual electrodes 144 as described above, a portion of the piezoelectric layer 142 interposed between the common electrode 143 and each individual electrode 144 is an active portion polarized in a thickness direction.

A method of discharging ink from a certain nozzle 125 included in the nozzles 125 by driving the piezoelectric actuator 102 is explained below. When the piezoelectric actuator 102 is in a standby state where no ink is discharged from the certain nozzle 125, all the individual electrodes 144 are kept at the ground potential that is the same as the common electrode 143. When ink is discharged from the certain nozzle 125, the electrical potential of the individual electrode 144 corresponding to the certain nozzle 125 is switched from the ground potential to the driving potential.

Then, similar to the first embodiment, a portion of the piezoelectric layers 141 and 142 overlapping in the up-down direction with the pressure chamber 120 is deformed to be convex toward the pressure chamber 120 as a whole. This reduces the volume of the pressure chamber 120 to increase the pressure of ink in the pressure chamber 120, thus discharging ink from the nozzle 125 communicating with the pressure chamber 120. After ink is discharged from the nozzle 125, the electrical potential of the individual electrode 144 returns to the ground potential.

The ink-jet head 100 according to this embodiment has, for example, the following function and effect. Similar to the first embodiment, in the ink-jet head 100, the inflow openings 128 are covered with the filters 131 of the filter member 130 and the outflow openings 129 are covered with no filters. The area S11 of the inflow opening 128 is larger than the area S12 of the outflow opening 129. Accordingly, it is possible to inhibit foreign matter from entering the channel unit 101, to facilitate the discharge of air bubbles, and to discharge ink stably.

In the ink-jet head 100 of this embodiment, similar to the first modified example (see FIG. 6), the inflow openings 128 are arranged between the piezoelectric actuator 102 and the outflow openings 129 in the conveyance direction. Namely, the outflow openings 129 are arranged upstream of the inflow openings 128 in the conveyance direction. The filters 131 of the filter member 130 are arranged downstream of the outflow openings 129 in the conveyance direction. In this configuration, the flow resistance of the inflow ink flowing toward the nozzles 125 (to the nozzle 125) can be decreased by arranging the filters 131 having a high flow resistance in positions closer to the nozzles 125. This makes the difference between the flow resistance of the inflow ink and the flow resistance of the outflow ink small, thus discharging ink from the nozzles 125 stably.

In the ink-jet head 100 of this embodiment, unlike the ink-jet head 3 of the first embodiment, the supply manifolds 126 overlap in the up-down direction with the return manifolds 127. The supply manifolds 126 are arranged above the return manifolds 127 in the up-down direction. Thus, the channel structure is complicated by arranging the outflow openings 129 that communicate with the return manifolds 127 at the downstream side in the conveyance direction with respect to the inflow openings 128 that communicate with the supply manifolds 126. The complicated channel structure increases the pressure loss of ink flowing therethrough. In this embodiment, the channel structure can be simplified by arranging the outflow openings 129 at the upstream side in the conveyance direction with respect to the inflow openings 128, thus inhibiting the pressure loss of ink flowing therethrough.

<Fifth and Sixth Modified Examples>

Figure 12:
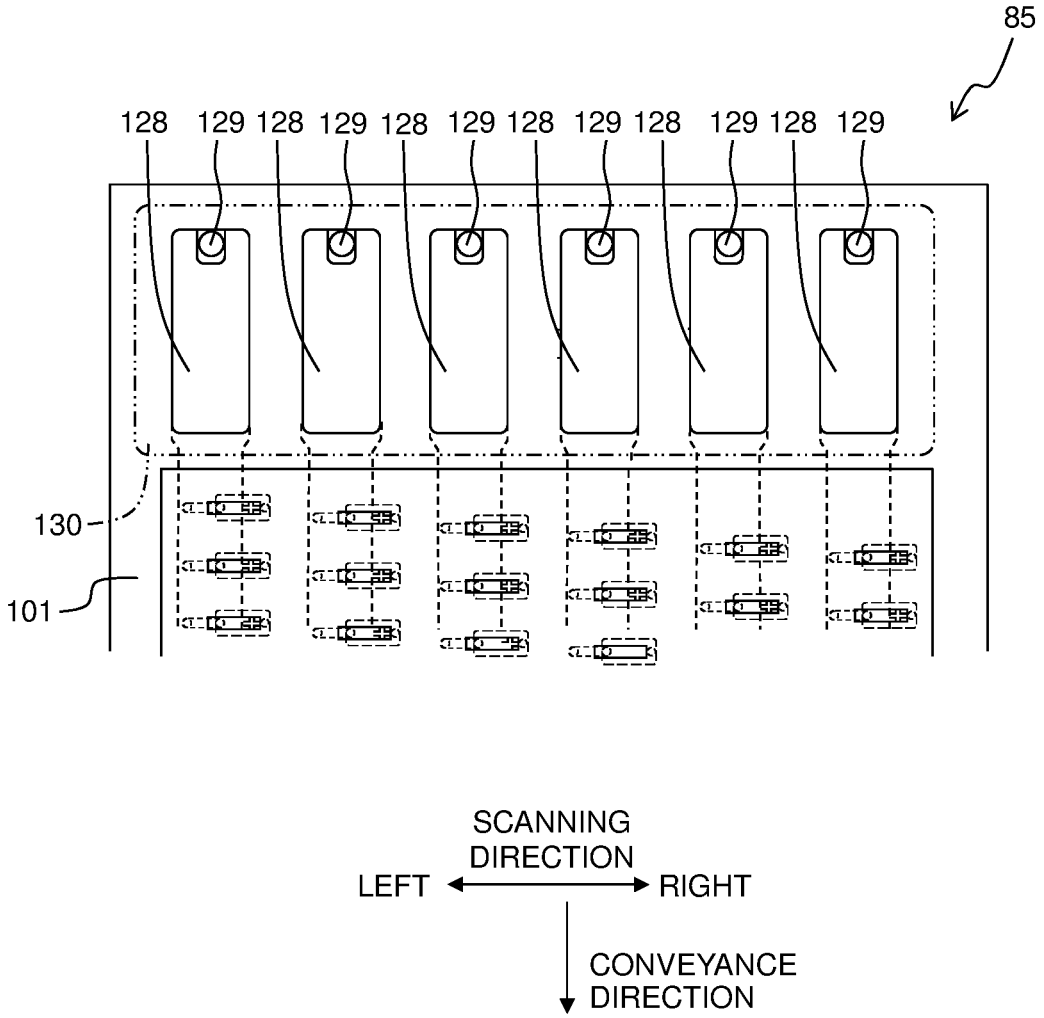
FIG. 12 is a schematic plan view of the vicinity of an inflow opening and an outflow opening in an ink-jet head according to the fifth modified example.
Figure 13:
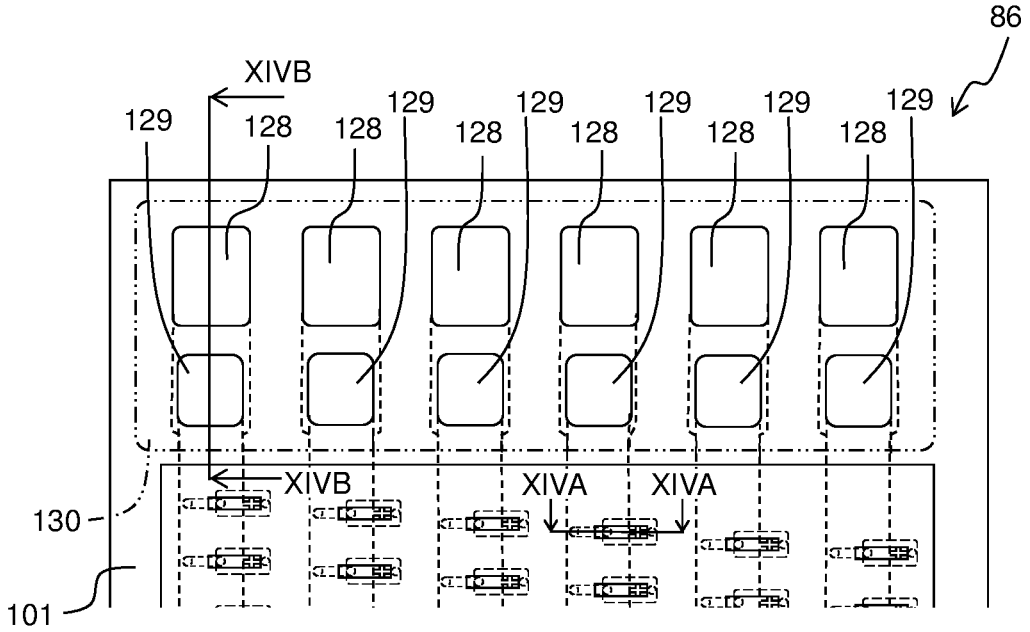
FIG. 13 is a schematic plan view of the vicinity of an inflow opening and an outflow opening in an ink-jet head according to the sixth modified example.
Figure 13:
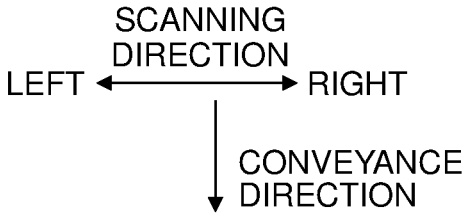
Figure 14A:
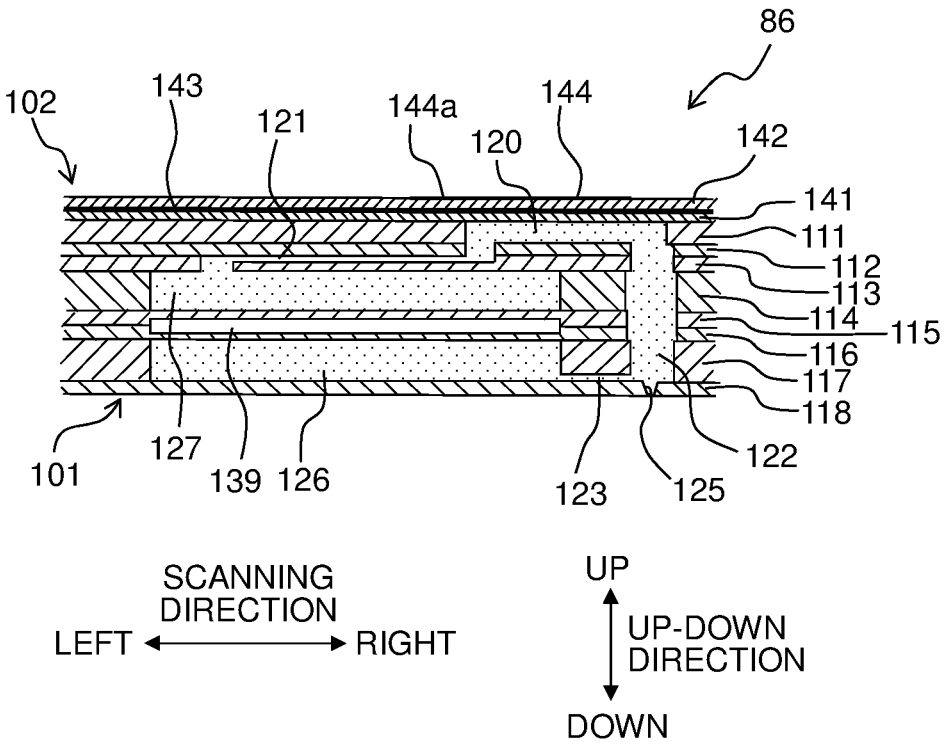
FIG. 14A is a cross-sectional view taken along a line XIVA-XIVA in FIG. 13.
Figure 14B:
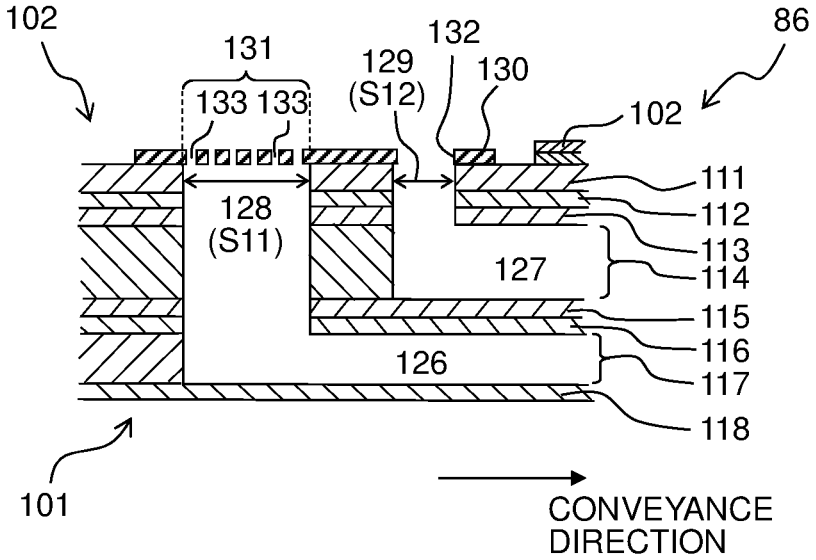
FIG. 14B is a cross-sectional view taken along a line XIVB-XIVB in FIG. 13.

In the ink-jet heads 85 and 86 according to the fifth and sixth modified examples, the shapes and/or arrangement of the inflow openings 128 and the outflow openings 129, the arrangement of the supply manifolds and the return manifolds, and the like are changed from those of the ink-jet head 100 according to the second embodiment, as depicted in FIGS. 12 to 14. Any other configurations than the above are similar to the ink-jet head 100 according to the second embodiment. In FIGS. 12 to 14, the constitutive parts or components, which are the same as or equivalent to those of the second embodiment, are designated by the same reference numerals. In the ink-jet heads 85 and 86 according to the fifth and sixth modified examples, similar to the second embodiment, the inflow openings 128 are covered with the filters 131 of the filter member 130, and the outflow openings 129 are covered with no filters. The area S11 of the inflow opening 128 is larger than the area S12 of the outflow opening 129. Accordingly, similar to the second embodiment, the ink-jet heads 85 and 86 according to the fifth and sixth modified examples inhibit foreign matter from entering the channel unit 101, facilitate the discharge of air bubbles, and discharge ink stably.

In the ink-jet head 100 of the second embodiment, the inflow openings 128 and the outflow openings 129 are arranged side by side in the conveyance direction. The inflow openings 128 and the outflow openings 129 are not arranged side by side in the scanning direction (see FIG. 10). The present disclosure, however, is not limited thereto. As depicted in FIG. 12, in the ink-jet head 85 according to the fifth modified example, the outflow openings 129 and parts of the inflow openings 128 are arranged side by side in the conveyance direction. The outflow openings 129 and another parts of the inflow openings 128 are arranged side by side in the scanning direction. Each inflow opening 128 extends in the conveyance direction so that the part of the inflow opening 128 and the outflow opening 129 are arranged side by side in the conveyance direction, and extends in the scanning direction so that the another part of the inflow opening 128 and the outflow opening 129 are arranged side by side in the scanning direction. As described above, the difference between the flow resistance of the inflow ink and the flow resistance of the outflow ink can be reduced by making the area of the inflow openings 128 larger than the area of the outflow openings 129. This allows ink to be stably discharged from the nozzles 125.

In the ink-jet head 100 of the second embodiment, the inflow openings 128 are arranged between the piezoelectric actuator 102 and the outflow openings 129 in the conveyance direction (see FIG. 10). The present disclosure, however, is not limited thereto. In the ink-jet head 86 according to the sixth modified example, as depicted in FIGS. 13 and 14, the return manifolds 127 are arranged above the supply manifolds 126 in the up-down direction. The outflow openings 129 are arranged between the piezoelectric actuator 102 and the inflow openings 128 in the conveyance direction. Namely, the inflow openings 128 are arranged upstream of the outflow openings 129 in the conveyance direction. The filters 131 of the filter member 130 are arranged upstream of the outflow openings 129 in the conveyance direction. In the sixth modified example, the return manifolds 127 are arranged above the supply manifolds 126. Thus, the channel structure is complicated by arranging the inflow openings 128 that communicate with the supply manifolds 126 at the downstream side in the conveyance direction with respect to the outflow openings 129 that communicate with the return manifolds 127. In this modified example, the channel structure can be simplified by arranging the inflow openings 128 at the upstream side in the conveyance direction with respect to the outflow openings 129, thus inhibiting the pressure loss of ink flowing therethrough. In the eighth modified example, the filters 131 of the filter member 130 can be arranged further separately from the piezoelectric actuator 102 that is a heat generation source. This inhibits the thermal deformation of the pores 133 of the filters 131.

The embodiments and modified examples of the present disclosure are explained above. The present disclosure, however, is not limited to the above. Various changes or modifications may be made without departing from the claims.

The examples in which the present disclosure is applied to the ink-jet head discharging ink from nozzles are explained above. The present disclosure, however, is not limited thereto. The present disclosure is applicable to any other liquid discharge head than the ink-jet head that discharges any other liquid than ink from nozzles.

What is claimed is:

1. A liquid discharge head, comprising:

a channel member having a nozzle surface parallel to a first direction and a second direction perpendicular to the first direction, and a back surface disposed separately from the nozzle surface in a third direction perpendicular to the first direction and the second direction, the channel member formed having a plurality of nozzles arranged in the nozzle surface, a plurality of individual channels connected to the plurality of nozzles, first and second common channels connected to the plurality of individual channels and extending in the first direction, a first opening that is opened in the back surface and communicates with an end at a first side in the first direction of the first common channel, and a second opening that is opened in the back surface and communicates with an end at the first side in the first direction of the second common channel, and a filter member disposed on the back surface and having a filter that covers the first opening, wherein the second opening is not covered with the filter, and an area of the first opening is larger than an area of the second opening, and wherein the first common channel, the first opening, and the filter are arranged in this order in the third direction.

2. The liquid discharge head according to claim 1, wherein the first common channel is a supply common channel through which a liquid flows from the first side toward a second side in the first direction so that the liquid is supplied to the plurality of individual channels, the second common channel is a return common channel through which the liquid returns from the plurality of individual channels and flows from the second side to the first side in the first direction, the first opening is an inflow opening through which the liquid flows into the supply common channel, and the second opening is an outflow opening through which the liquid flows out of the return common channel.

3. The liquid discharge head according to claim 1, further comprising a piezoelectric actuator disposed on the back surface of the channel member, wherein the second opening is disposed between the piezoelectric actuator and the first opening in the first direction.

4. The liquid discharge head according to claim 1, further comprising a piezoelectric actuator disposed on the back surface of the channel member, wherein the first opening is disposed between the piezoelectric actuator and the second opening in the first direction.

5. The liquid discharge head according to claim 1, wherein the filter member includes a through hole communicating with the second opening, and the first opening and the second opening are arranged in an area surrounded by an outer circumference of the filter member when seen from the third direction.

6. The liquid discharge head according to claim 5, wherein an absolute value of a difference between a first flow resistance ($R_{in}$) of a liquid and a second flow resistance ($R_{out}$) of the liquid is equal to or less than 1 kPa per a viscosity of the liquid of 1 mPa·s, the first flow resistance ($R_{in}$) of the liquid passing through the filter of the filter member and then flowing through the first common channel from the first opening by a predefined length, and the second flow resistance ($R_{out}$) of the liquid flowing through the second common channel by the predefined length to reach the second opening and then passing through the through hole of the filter member.

7. The liquid discharge head according to claim 1, wherein the filter member is disposed not to overlap with the second opening in the third direction.

8. The liquid discharge head according to claim 1, wherein the second opening is circular.

9. The liquid discharge head according to claim 1, wherein the second opening and part of the first opening are arranged side by side in the first direction, and the second opening and another part of the first opening are arranged side by side in the second direction.

10. The liquid discharge head according to claim 1, wherein the first common channel and the second common channel are arranged side by side in the second direction.

11. The liquid discharge head according to claim 1, wherein the first common channel overlaps in the third direction with the second common channel.

12. The liquid discharge head according to claim 1, wherein each of the individual channels includes:

a pressure chamber disposed separately from the nozzle surface in the third direction to communicate with the first common channel or the second common channel, a connection channel connected to the pressure chamber, extending in the third direction, and forming part of a channel that causes the pressure chamber to communicate with a corresponding nozzle, and a circulation channel connected to the connection channel, extending along a plane parallel to the nozzle surface, and forming a channel that causes the connection channel to communicate with the corresponding nozzle.

* * * * *